US009453389B2

(12) United States Patent
Anderson et al.

(10) Patent No.: US 9,453,389 B2
(45) Date of Patent: Sep. 27, 2016

(54) FLUID INJECTION DEVICE

(75) Inventors: Ian Anderson, Cambridgeshire (GB); Peter Watson, Cambridgeshire (GB)

(73) Assignee: CAMCON OIL LIMITED, Cambridgeshire (GB)

( * ) Notice: Subject to any disclaimer, the term of this patent is extended or adjusted under 35 U.S.C. 154(b) by 549 days.

(21) Appl. No.: 13/879,670

(22) PCT Filed: Oct. 19, 2011

(86) PCT No.: PCT/GB2011/052023

§ 371 (c)(1),
(2), (4) Date: Apr. 16, 2013

(87) PCT Pub. No.: WO2012/052759

PCT Pub. Date: Apr. 26, 2012

(65) Prior Publication Data

US 2013/0199796 A1 Aug. 8, 2013

(30) Foreign Application Priority Data

Oct. 20, 2010 (GB) ..... 1017698.0

(51) Int. Cl.

| | |
|---|---|
| ***E21B 34/10*** | (2006.01) |
| ***E21B 37/06*** | (2006.01) |
| ***E21B 43/12*** | (2006.01) |

(52) U.S. Cl.

CPC ..... *E21B 34/10* (2013.01); *E21B 34/101* (2013.01); *E21B 37/06* (2013.01); *E21B 43/123* (2013.01)

(58) Field of Classification Search

CPC .. E21B 43/122; E21B 43/123; E21B 43/162; E21B 43/255; E21B 43/166; E21B 43/168; E21B 34/066; F16K 31/082; F16K 31/003

See application file for complete search history.

(56) References Cited

U.S. PATENT DOCUMENTS

| | | | | |
|---|---|---|---|---|
| 3,050,121 | A * | 8/1962 | Garrett et al. | 166/285 |
| 5,168,933 | A | 12/1992 | Pritchard, Jr. et al. | |
| 2003/0048697 | A1 * | 3/2003 | Hirsch et al. | 367/82 |
| 2004/0060703 | A1 * | 4/2004 | Stegemeier et al. | 166/310 |

(Continued)

FOREIGN PATENT DOCUMENTS

| | | |
|---|---|---|
| CN | 1208808 A | 2/1999 |
| CN | 1890453 A | 1/2007 |

(Continued)

OTHER PUBLICATIONS

Espacenet, English Machine Translation of Abstract for CN1208808A, published Feb. 24, 1999, retrieved from http://worldwide.espacenet.com on Jul. 10, 2015 (1 page).

(Continued)

*Primary Examiner* — Kipp Wallace
(74) *Attorney, Agent, or Firm* — The Kubiak Law Firm, PLLC

(57) ABSTRACT

A fluid injection device (18) for controlling injection of fluid into an oil-carrying tube in an oil well includes an inlet (20) for receiving the fluid; an outlet (28) for supplying the fluid for injection into the oil-carrying tube; an inlet valve (22) in a fluid path between the inlet and the outlet; an actuator (24) for opening and closing the valve; and a connector (36) for coupling the inlet to a fluid supply tube (32) extending between the device and a source of the fluid above the ground. A method of controlling injection of fluid using such a device is also provided.

11 Claims, 3 Drawing Sheets

(56) References Cited

U.S. PATENT DOCUMENTS

| | | | | |
|---|---|---|---|---|
| 2006/0021750 | A1 | 2/2006 | Lugtmeier et al. | |
| 2006/0096760 | A1* | 5/2006 | Ohmer | 166/304 |
| 2007/0235197 | A1* | 10/2007 | Becker et al. | 166/372 |
| 2008/0179063 | A1* | 7/2008 | Smith | 166/335 |
| 2009/0078428 | A1* | 3/2009 | Ali | 166/373 |
| 2010/0096127 | A1 | 4/2010 | Jordy | |
| 2010/0101788 | A1* | 4/2010 | Mennem et al. | 166/268 |
| 2011/0024111 | A1* | 2/2011 | Moen et al. | 166/278 |
| 2011/0079398 | A1* | 4/2011 | Patel et al. | 166/373 |

FOREIGN PATENT DOCUMENTS

| | | | |
|---|---|---|---|
| WO | 9902819 | A1 | 1/1999 |
| WO | 00/04274 | A1 | 1/2000 |
| WO | 2008091345 | A1 | 7/2008 |
| WO | 2009/147446 | A2 | 12/2009 |
| WO | 2010/051255 | A1 | 5/2010 |

OTHER PUBLICATIONS

Espacenet, English Machine Translation of CN1890453A, published Jan. 3, 2007, retrieved from http://worldwide.espacenet.com on Jul. 10, 2015 (11 pages).

Chinese Patent Office, English Translation of Search Report, Application No. 2011800502093, mailed Jun. 23, 2015 (2 pages).

United Kingdom Intellectual Property Office, Patents Act 1977: Search Report under Section 17, Application No. GB1017698.0, dated Apr. 6, 2011 (1 page).

European Patent Office, International Search Report and Written Opinion of the International Searching Authority, International Application No. PCT/GB2011/052023, dated Feb. 14, 2013 (12 pages).

* cited by examiner

FLUID INJECTION DEVICE

BACKGROUND OF THE INVENTION

When producing liquid hydrocarbons (oil) from a reservoir the use of a gas lift device is common within the industry. FIG. 1 shows a diagram of an oil well with a single gas lift device fitted.

In FIG. 1, an oil well extends down to an oil reservoir 2 and contains a gas tube 4. Oil is able to flow into the tube 4 via perforations 6 close to the base of the tube. An oil-producing tube 8 extends centrally along the gas tube 4 so that an elongated annular space 10 is defined between the two tubes. A packer 12 forms a seal between the two tubes, above the perforations 6. A gas injection point 14 allows gas pumped into the annular via inlet 16 to be injected into the oil-producing tube 8.

Oil in a reservoir is generally at too low a pressure to flow freely to the surface and therefore needs some kind of artificial lift to ensure this. Gas injection is one such method which works by injecting gas at pressure into the oil producing tube 8, which has the effect of making the column of oil lighter and therefore it rises further up the tube. This in turn allows more gas to be injected and the entire column will then get lighter causing a continuous flow of oil. The gas can subsequently be removed from the oil by a separator (not shown).

When producing oil from a reservoir, the oil produced may be cut with other chemicals such as water, sulphides and many others. These impurities can lead to corrosion in the well bore and also to scaling within the walls of the oil producing well. Chemicals are used to protect the walls of the tubing and to reduce or remove scaling.

A known method for performing chemical injection is to have a dedicated mandrel that has a port for injecting chemicals.

These injection valves work by increasing the pressure of the injection fluid to be above that of the reservoir to force open the valve so that it allows the fluid to pass through. To stop the flow, the fluid pressure is reduced to allow the valve to close. Pressure control of the valve in this way means that the downhole valve mechanism is relatively simple and therefore more durable and reliable. However, this approach requires a dedicated supply line to each of the injection points along an oil producing tube.

SUMMARY OF THE INVENTION

The present invention provides a fluid injection device for controlling injection of fluid into an oil-carrying tube in an oil well, the device including:

- an inlet for receiving the fluid;
- an outlet for supplying the fluid for injection into the oil-carrying tube;
- an inlet valve in a fluid path between the inlet and the outlet;
- an actuator for opening and closing the valve; and
- a connector for coupling the inlet to a fluid supply tube extending between the device and a source of the fluid above the ground.

According to a further aspect, the invention also provides an assembly including a fluid injection device as defined above, in combination with a gas injection device, the gas injection device being arranged to control the injection of gas into the oil-carrying tube to lift oil up the tube.

The invention further provides a method of controlling injection of fluid into an oil-carrying tube in an oil well, comprising the steps of:

- providing a fluid injection device as defined above;
- coupling the connector to a fluid supply tube extending between the device and a source of the fluid above the ground; and
- selectively operating the actuator so as to inject the fluid into the oil-carrying tube via the outlet.

BRIEF DESCRIPTION OF THE DRAWINGS

A know gas lift configuration and an embodiment of the invention will now be described with reference to the accompanying schematic drawings, wherein.

DETAILED DESCRIPTION OF THE INVENTION

In a preferred embodiment, a chemical injection valve (or valves) is incorporated into an artificial gas lift unit which is equipped with two or more injection ports. These injection ports can be independently actuated to allow fluid or gas flow and do not rely on an over pressure being applied to actuate the respective valves. In this way, the same unit can be used to control liquid injection via one or more injection ports, and gas injection via one or more other ports, with each port being independently switchable.

Figure 1:
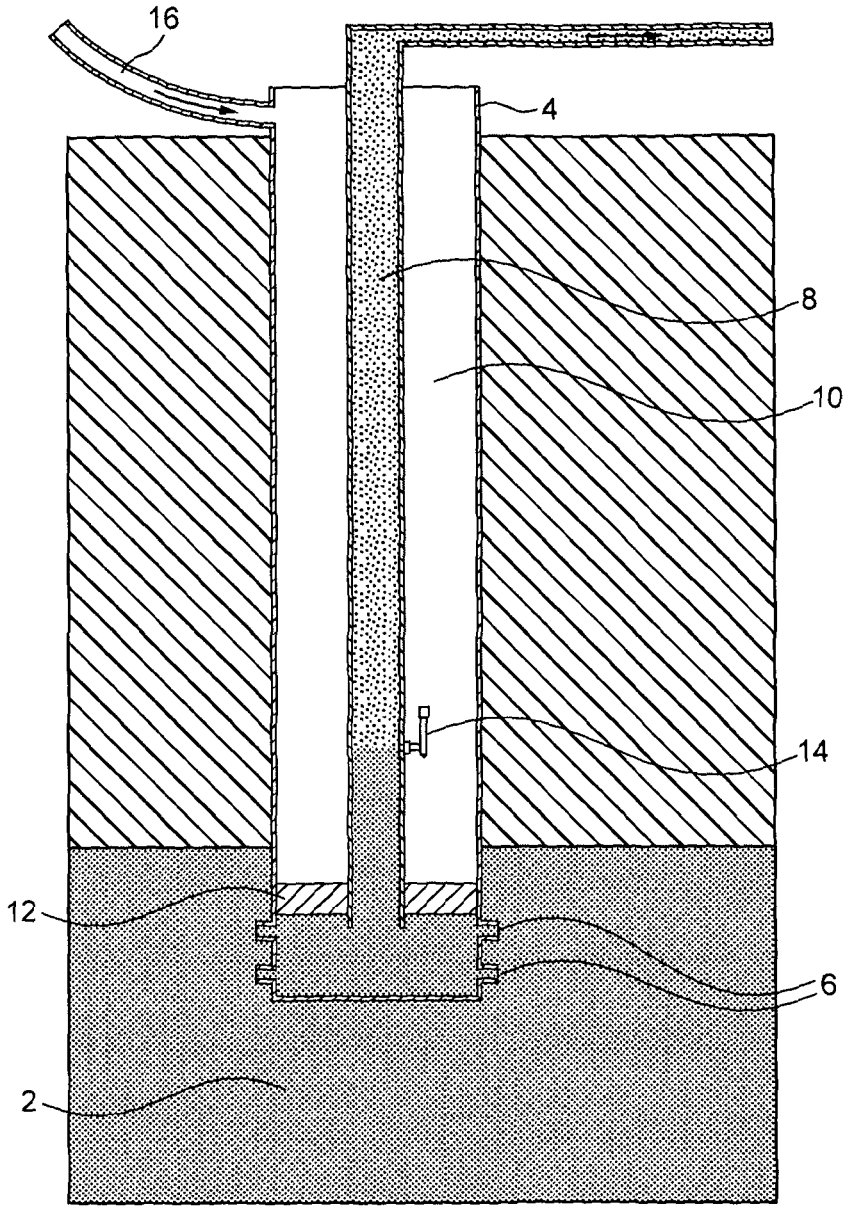
FIG. 1 is a cross-sectional view of a known gas lift arrangement.
Figure 2:
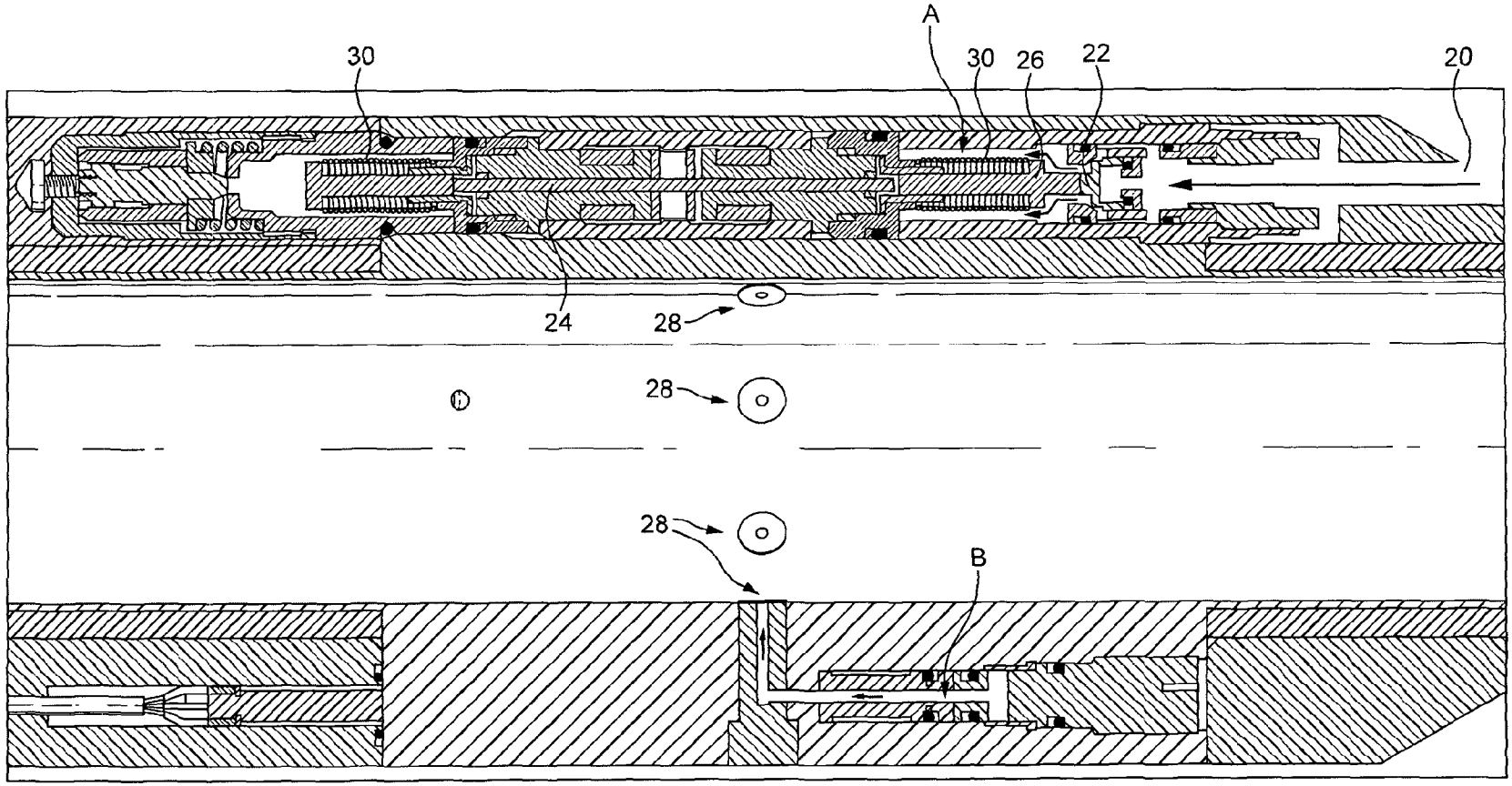
FIG. 2 is a cross-sectional view of a known gas lift device.

A longitudinal cross-sectional view of part of a gas lift unit is shown in FIG. 2. A gas lift unit of this configuration is disclosed in International Publication No. WO 2009/147446, filed by the present applicant, the contents of which are incorporated herein by reference.

In this unit, the gas which is in the annulus enters the device via inlet 20 but is stopped by the valve 22. When the actuator 24 is moved, the actuator pin 26 bears on it opening the valve. This allows gas to enter the device and a conduit leads from point A in the inlet to a paired outlet port B where gas can then enter the production pipe in the centre of the device via a respective one of the orifices 28.

A in the inlet to a paired outlet port B where gas can then enter the production pipe in the centre of the device via a respective one of the orifices 28.

For the purposes of illustration, the valve and port B are shown on opposites sides of the device in FIG. 2. It will be appreciated that in practice they can be located adjacent to each other.

Figure 3:
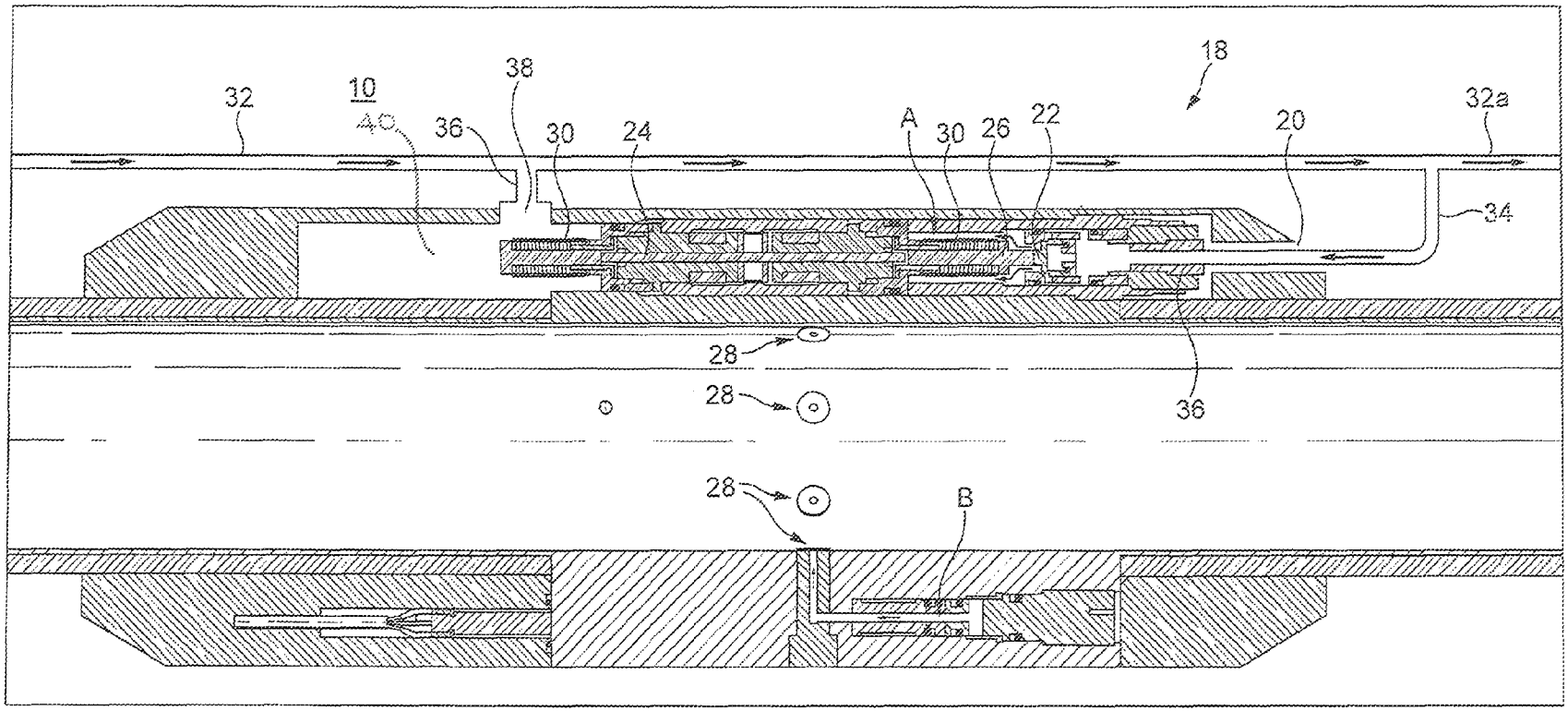
FIG. 3 is a cross-sectional view of a fluid injection device according to an embodiment of the invention.

A fluid injection device 18 embodying the invention is shown in FIG. 3. A chemical supply pipe 32 extends along annulus 10. A feed pipe 34 couples supply pipe 32 to valve 22 of the device via inlet 20. A connector 36 provides a fluidically sealed coupling between the feed pipe 34 and the valve 22.

To use one of the valves as a chemical injection unit, bellows 30 on each side of the valve actuator 24 need to be exposed to the same pressure. This can be achieved by coupling their exteriors to the chemical supply from pipe 32. A branch pipe 36 extends between the supply pipe 32 and a device port 38 which is in fluid communication with chamber 40 adjacent the bellows 30 on the side of the actuator 24 opposite the valve 22.

As can be seen in FIG. 3, the chemical supply pipe 32 can then continue on to a further device via section 32*a*. In contrast to the known technique discussed above, the invention facilitates use of a single supply pipe to feed multiple injection points with the ability to control injection at each point independently of the other.

Further advantages of this arrangement:

1. Chemical injection can be applied at any position where a gas lift unit is fitted. This overcomes the need for an additional piece of equipment.
2. An individual chemical injection valve can be switched on without affecting others. This makes control easier and more logical as it is only a case of opening a valve.
3. A single pipe for chemical injection can be put down the well for all devices. This can be used for many different chemicals that may need injecting at different points (some purging of the previous chemical will occur). This has the advantage of reducing the amount of down hole tubing, which is costly to install.
4. The actuator is preferably a type which is held in one of its stable states without consuming electrical power. It may be retained in a selected state by means of internally generated mechanical and/or magnetic forces only, requiring only a short electrical pulse to switch it to another state. This means that the injection device can be deployed down a well for long periods of time without reliance on a constant supply of power from the surface or downhole batteries. Suitable actuator configurations are described for example in United Kingdom Patent Nos. 2342504 and 2380065, International Patent Publication No. WO 2009/147446 and U.S. Pat. No. 6,598,621, the contents of which are incorporated herein by reference.

The invention claimed is:

1. A fluid injection device for controlling injection of fluid into an oil-carrying tube in an oil well, the device including:

a housing, the housing further including; an inlet for receiving the fluid;

an outlet for supplying the fluid for injection into the oil-carrying tube; an inlet valve in a fluid path between the net and the outlet; a linear bistable electrical actuator for opening and closing the net valve; and a connector for coupling the net valve to a fluid supply tube extending between the fluid injection device and a source of the fluid, wherein the linear bistable electrical actuator has two stable states in which the net valve is held dosed and open, respectively, by the linear bistable electrical actuator and wherein the valve is coupled to one end of the linear bistable electrical actuator, and the other end of the linear bistable electrical actuator is mechanically coupled to the pressure hi the fluid supply tube, to substantially equalize the external pressure acting on each end of the actuator.

2. The device of claim 1, including a second inlet for connection to the fluid supply tube, wherein the second inlet is in fluid communication with a chamber defined within the fluid infection device, the fluid pressure in the chamber being mechanically coupled to the a second end of the linear bistable electrical actuator.

3. The device of claim 1, wherein the housing further includes a gas injection device, the gas injection device being arranged to control the injection of gas into the oil-carrying tube to lift oil up the tube.

4. The device of claim 1, wherein the housing further includes a gas injection device, the gas injection device being arranged to control the injection of gas into the oil-carrying tube to lift oil up the tube.

5. The device of claim 2, wherein the housing further includes a gas injection device, the gas injection device being arranged to control the injection of gas into the oil-carrying tube to lift oil up the tube.

6. A method of controlling injection of fluid into an oil-carrying tube in an oil well, comprising the steps of:

providing a fluid injection device; wherein the fluid injection device further includes:

a housing, the housing further including; an inlet for receiving the fluid;

an outlet for supplying the fluid for injection into the oil-carrying tube; an inlet valve in a fluid path between the inlet and the outlet; a linear bistable electrical actuator for opening and closing the inlet valve; and a connector for coupling the inlet valve to a fluid supply tube extending between the fluid injection device and a source of the fluid, wherein the linear bistable electrical actuator has two stable states in which the inlet valve is held closed and open, respectively, by the linear bistable electrical actuator;

coupling the connector to a fluid supply tube extending between the device and a source of the fluid;

selectively operating the bistable electrical actuator so as to inject the fluid into the oil-carrying tube via the outlet, and coupling the valve to a first end of the linear bistable electrical actuator, and coupling a second end of the linear bistable electrical actuator to the pressure in the fluid supply tube, to substantially equalize the external pressure acting on each end of the actuator.

7. The method of claim 6, including a further step of coupling the fluid supply tube to a second fluid injection device at a second longitudinally spaced location along the oil-carrying tube.

8. The method of claim 6, further including the step of connecting a second inlet to the fluid supply tube, wherein the second inlet is in fluid communication with a chamber defined within the fluid infection device, the fluid pressure in the chamber being mechanically coupled to a second end of the linear bistable electrical actuator.

9. The method of claim 6, further including the step of providing a gas infection device; wherein the gas injection device controls the injection of gas into the oil-carrying tube to lift oil up the tube.

10. The method of claim 6, wherein the housing further includes a gas injection device, the gas injection device being arranged to control the injection of gas into the oil-carrying tube to lift oil up the tube.

11. The method of claim 8, wherein the housing further includes a gas injection device, the gas injection device being arranged to control the injection of gas into the oil-carrying tube to lift oil up the tube.

* * * * *